United States Patent [19]

Murphy

[11] Patent Number: 4,869,982

[45] Date of Patent: Sep. 26, 1989

[54] ELECTROPHOTOGRAPHIC PHOTORECEPTOR CONTAINING A TONER RELEASE MATERIAL

[75] Inventor: William J. Murphy, San Jose, Calif.

[73] Assignee: X-Solve, Inc., San Jose, Calif.

[21] Appl. No.: 45,682

[22] Filed: Apr. 30, 1987

[51] Int. Cl.[4] ..... G03G 5/14

[52] U.S. Cl. ..... 430/48; 430/58; 430/66; 430/126

[58] Field of Search ..... 430/48, 56, 58, 66, 430/126

[56] References Cited

U.S. PATENT DOCUMENTS

| | | | |
|---|---|---|---|
| 4,371,600 | 2/1983 | Schank et al. | 430/56 |
| 4,487,823 | 12/1984 | Lehmann et al. | 430/56 |
| 4,613,556 | 9/1986 | Mort et al. | 430/66 |
| 4,663,259 | 5/1987 | Fujimura et al. | 430/58 |

*Primary Examiner*—John L. Goodrow

*Attorney, Agent, or Firm*—Perman & Green

[57] ABSTRACT

An organic photosensitive member for use in electrophotography comprising a conductive substrate and one or more electrically operative layers is disclosed. The imaging layer of the member contains from about 0.5 to about 20 percent of a toner release agent selected from the group of materials composed of stearates, silicon oxides, and fluorocarbons.

11 Claims, 1 Drawing Sheet

ELECTROPHOTOGRAPHIC PHOTORECEPTOR CONTAINING A TONER RELEASE MATERIAL

BACKGROUND OF THE INVENTION

The present invention relates to layered photosensitive members used in electrophotography and, in particular, to improved imaging members.

In the process of electrophotography employing a reusable electrophotographic plate, the plate is uniformily electrostatically charged in darkness and then selectively discharged by exposure to an optical image of the original subject to be copied. The resulting latent electrostatic image develops into a visible image by dusting the electrophotographic plate with finally divided electrostatically attractable toner particles. After the visible toner image is transferred from the plate to a permanent support, such as paper, the plate typically passes through a cleaning station where the remaining toner particles are removed so that the plate may be recycled continuously in the electrophotographic process. Plate cleaning is ordinarily accomplished by means of a soft brush, cleaning web or blade which physically removes the toner particles.

Historically, various electrophotographic photoconductive members have been developed for use for various document reproduction processes. All of these photoconductive elements have their own limitations. For example, a selenium based photoconductive element is not flexible enough for use in sheet like or belt form. Moreover, it is vulnerable to conditions of heat. Zinc oxide based photoconductors are brittle and have low photosensitivity. The development of organic photoconductors such as disclosed in U.S. Pat. No. 3,378,612 to Hoegle et al. overcomes the above disadvantages but these organic photoreceptors have a relatively short use life which is an extreme disadvantage with respect to photoreceptors contemplated for use in high speed automatic electrophotographic machines.

In response to the deficiencies of the aforementioned photoconductors, composite layer photoreceptors containing a photoconductor in another material were developed. One type of composite photoconductive layer is illustrated in U.S. Pat. No. 3,121,006 which describe a number of layers comprising finely divided particles of a photoconductive inorganic compound dispersed in an electrically insulating organic resin binder. The binder material disclosed in this patent comprise a material which is incapable of transporting charge carriers generated by the photoconductive particles for any significant distance. In U.S. Pat. No. 4,265,990 there is disclosed layered photoreceptors having separate photogenerating layers and charge transport layers.

Although the above patents rely upon distinct mechanisms of discharge throughout the photoconductive layer, they generally suffer from common deficiencies in that the photoconductive surface during operation is exposed to the surrounding environment and, particularly in the case of repetitive electrophotographic cycling, these photoconductive layers are susceptible to abrasion, chemical attack, heat and multiple exposure to light. These effects are characterized by a gradual deterioration in the electrical characteristics of the photoconductive layer resulting in the printing out of surface defects and scratches, localized areas of present conductivity which fail to retain an electrostatic charge, and high dark discharge.

As a practical matter, a photoreceptor element must be recycled many times in present commercial electrophotographic processes. Consequently, the imaging layer is subjected to considerable destructive abrasion, especially in the cleaning process. The electrical properties of the photoreceptor layer generally require that it must be extremely thin. Since it is also highly desirable to maintain the uniformity of the photoconductive layer, the photoreceptor is susceptible to deterioration from an abrasion of the photoconductive layer during a web, brush, blade, or other cleaning method in the electrophotographic process. Moreover, when the process requires increased image density by deposition of greater quantities of toner particles on the latent electrostatic image of the photoreceptor, an undesirable increase in background deposits of toner generally results. This, of course, exacerbates the deterioration process because there is greater abrasion required in the cleaning process. These difficulties are particularly acute with organic photoreceptors which have notoriously short use lives because of the physical wear and deterioration inherent in the cleaning and transfersteps of the electrophotographic process.

In response to the longevity problem of organic photoreceptors, it has been found that the use of toner release materials in certain photoreceptors results in photoconductive elements which have a relatively long use life thereby rendering them particularly useful in present day automatic electrophotographic copiers.

OBJECTS OF THE INVENTION

It is therefore an object of this invention to provide a long life photoreceptor which overcomes the above noted deficiencies.

It is further object of this invention to provide xerographic photoreceptor elements which enhance the transfer of toner particles in background areas of image surfaces to carrier elements.

It is a still further object of this invention to provide an electrophotographic photoreceptor member from which toner particles are easily removed by cleaning devices.

It is another object of this invention to provide organic electrophotographic photoreceptors which promote the formation of dense transferred toner images.

It is still another object of this invention to provide an organic electrophotographic photoreceptor having physical and electrical properties superior to those presently known.

SUMMARY OF THE INVENTION

The foregoing objects and others are accomplished in accordance with this invention by providing a photosensitive member having an organic photoreceptor comprising an electrically active material and a photogenerating material in combination with a toner release agent. The organic photoreceptor may be a single layer or multilayered configuration. The first layer comprises photoconductive material which is capable of photogenerating and injecting photogenerated holes into a contiguous or adjacent electrically active layer. The imaging surface layer of the present organic photoreceptor contains from about 0.5 to 20 percent by weight of a toner release agent selected from the group composed of stearates, silicon oxides and fluorocarbons. It has been found that the present organic photoreceptor enhances the transfer of toner from the imaging surface during the carrier transfer step and facilitates removal of the residual toner during the cleaning step of the electrophotographic process. The present photosensitive member achieves a longer use life than heretofore possible with known photoreceptors employing organic materials.

BRIEF DESCRIPTION OF THE DRAWINGS

The advantages of the improved structure and method of imaging will become apparent upon consideration of the following disclosure of the invention, especially when taken in conjunction with the accompanying drawings wherein.

DETAILED DESCRIPTION OF A PREFERRED EMBODIMENT

Figure 1:
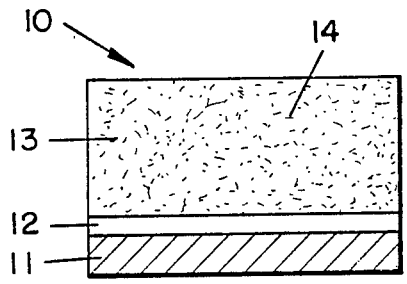
FIG. 1 is a partially schematic cross-sectional view of a multilayered configuration of the photosensitive element of the present invention in which the toner release agent is completely dispersed throughout the top imaging layer.
Figure 2:
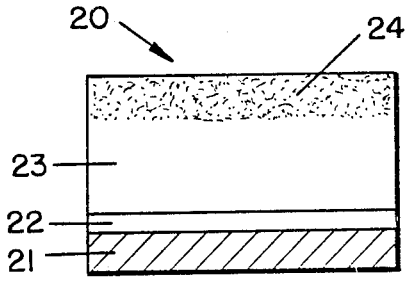
FIG. 2 is a partially schematic cross-sectional view of another embodiment of the multilayered photosensitive element of FIG. 1 in which the toner release agent is concentrated at the surface of the imaging layer.

In the drawings, FIGS. 1 and 2 represent two embodiments of a multilayered photoreceptor plate within the scope of the present invention. They are both basically similar in that they comprise a substrate, a charge generation layer thereon and a charge transport layer over the generation layer.

In FIG. 1, photoreceptor 10 consists of substrate 11, a charge generation layer 12 comprising photoconductive material or photoconductor particles dispersed randomly in an insulating organic resin; and a charge transport layer 13 comprising a transparent electrically active material having dissolved therein from 0.5 to about 20weight percent of the toner release materials 14 of the present invention.

In FIG. 2, photoreceptor 20 differs from FIG. 1 in that the toner release material 24 is concentrated in the surface of the charge transport layer. Here the greater concentration of the toner release materials toward the surface of the imaging layer allow greater release and cleanability potential for the photoreceptor 20. However, the amount of toner release material 24 is preferably at the lower end of the range cited above because of potential interference of charge generated holes in photoconductor 22 on through charge transport layer 23 and interference with charge migration at the surface layer.

Figure 3:
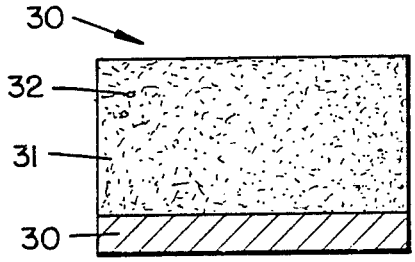
FIGS. 3 and 4 are also partially schematic crosssectional views of single layer embodiments of the photosensitive element of the present invention in which pure organic photoconductor is used as the imaging surface.

In FIG. 3, there is illustrated a single layered photoreceptor 30 comprising an organic photoconductor 31 in which the toner release materials 32 of the present invention are dispersed in a concentration of 0.5 to about 20 weight percent and overlaid on a conductive substrate 30.

Figure 4:
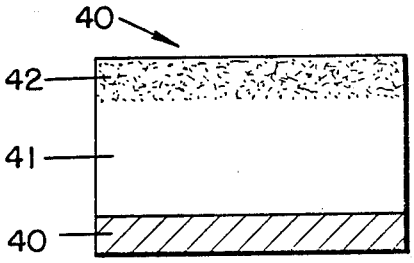

FIG. 4 illustrates a photoreceptor 40 which differs from FIG. 3 in that the toner release materials 42 concentrated on the surface of the imaging organic photoconductor layer and overlaid on a conductive substrate 40. This has much the same beneficial effect as articulated for the surface dispersion configuration of FIG. 2, that is, the toner release materials being at the surface of the imaging layer enables greater transferability and cleanability of the photoreceptor system. Additionally, the concentration of toner release material in this configuration is prefereably at the lower end of the above cited range to achieve uninhibited charge transport through the photoconductor 41.

Figure 5:
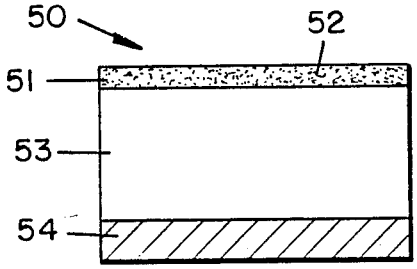
FIG. 5 is also a partially schematic cross-sectional view of another multilayered embodiment of the photosensitive element of the present invention in which positive charge imaging can take place.

In FIG. 5 there is demonstrated another dual layered photoreceptor 50 in which the charge generation or photoconductor layer is the surface layer 51 having the toner release materials 52 dispersed therein and overlaying a charge transport layer 53 which is affixed to a conductive substrate 54. The benefits of this configuration is that positive charge imaging can take place at the surface of the charge generation layer 51 whereby electrons generated therein migrate to the surface to dissipate the positive charge while the holes transport across the charge transport layer 53 on through the conductive substrate 54.

Figure 6:
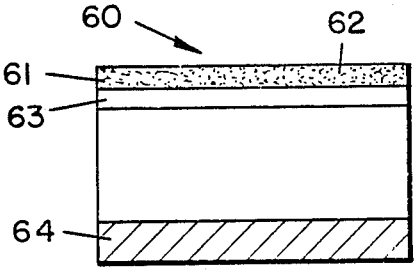
FIG. 6 illustrates a further embodiment of the multilayered configuration of FIG. 5 in which a toner release filled overlayer is applied to the imaging surface.

In FIG. 6, there is illustrated a further embodiment of the instant photoreceptor wherein the configuration of FIG. 5 is further overlaid with a protective coating comprising the toner release materials 61 of the present invention being dispersed in an organic binder material 62 and coated on the charge generation layer 63 in a thin layer. While demonstrated for the configuration of FIG. 5 it is apparent to anyone skilled in the art that the same protective overlayer can be applied to any photoreceptor including the embodiments demonstrated in FIGS. 1 through 4. The overlayer in FIG. 6 must be thin enough to permit charge to operate through and effectively reach the photoconductive layer. The film forming binder material 62 may comprise any suitable polymer. Typical polymers include, among others: cellulose, especially nitrocellulose and ethycellulose; lacquers; urea-formaldehyde resins; medium hard para-sulfonamide resins; alkyd resins; silicone resins and acrylic ester resins.

In the devices of the present invention as illustrated in FIGS. 1 through 6, the substrate may be of any suitable conductive material, e.g. aluminum, steel, brass, graphite, dispersed conductive salts, conductive polymers or the like. The substrate may be rigid or flexible and of any conventional thickness. Typical substrate forms include flexible belts or sleeves, sheets, webs, plates, cylinders and drums. The substrate may also comprise a composite structure such as a thin conductive layer, such as aluminum or copper iodide, or glass coated with a thin conductive layer of chromium or tinoxide. Particularly preferred as substrates are metalized polyesters, such as aluminized Mylar.

In addition, an electrically insulating substrate may be used. In this case, the charge may be placed upon the insulating member by double corona charging techniques which are well known and disclosed in the art. Other modifications include using an insulating substrate or no substrate at all including placing the imaging member on a conductive backing member or plate and charging the surface while in contact with said backing member. Subsequent to imaging, the imaging member may then be stripped from the photoconductive backing.

The photogeneration layers illustrated in FIGS. 1 through 6 may consist of any suitable organic or inorganic photoconductor and mixtures thereof. Inorganic materials include inorganic crystalline photoconductive compounds and inorganic photoconductive glasses. Typical inorganic compounds include cadmium sulfoselenide, cadmium selenide, cadmium sulfide and mixtures thereof. Typical inorganic photoconductive glasses include selenium and selenium alloys such as selenium-tellurium, selenium-tellurium arsenic and selenium-arsenic and mixtures thereof. Selenium may also be used in a crystalline form known as trigonal selenium.

Typical organic photoconductive materials which may be used as charge generators within the purview of the present invention include phthalocyanine pigments, pyrylium dyes, thioprylium dyes, triarylmethane dyes, thiazine dyes, cyanine dyes, perylene pigments, indigo pigments, thioindigo pigments, quinacridone pigments, squaric acid pigments, azo pigments, polycyclic quinone pigments, and the like.

The charge transport layers illustrated in FIGS. 1 through 6 may be any material which is capable of transporting holes, these layers generally having a thickness in the range from about 5 microns to about 50 microns, and preferably from about 15 microns to about 35 microns. Typical materials include charge transfer complexes such as 1:1 mixture of poly(N-vinylcarbazole) and trinitrofluorenone and organic doner materials such as hydrazones, oxidiazoles, triphenylmethanes, diamines, pyrazolines, styrils, anthracenes, triazoles, stilbines, etc.

When active donor materials are used, typically they are contained in an inactive binder material such as polycarbonates, polyester resins, epoxy resins, polyurethanes, acrylic resins, alkyd resins, polysulfone, methacrylic resins, vinyl chloride resin, vinyl acetate resin, phenolic resins, or copolymers containing two or more kinds of repeating units of these resins. The amount of binder material is typically in the range from 20 to 80 percent and preferably from about 40 to 60 percent. It is also possible to use as the binder material photoconductive polymers such as poly(N-vinylcarbozole) which in themselves have charge transporting ability.

In the electrophotographic plates of the present invention, the charge transport layer may be used either on top of the charge generating layer, or beneath the charge generating layer as indicated in FIGS. 1, 2, 5 and 6. To give additional mechanical strength to the photoreceptor, it is generally preferred that the charge transport layer be on top. When the charge transport is on top of the charge generating layer, i.e. when the charge generating layer is between the charge transport layer and the conductive substrate, the xerographic plate should be charged negatively. In those instances where the charge transport is between the charge generating layer and the conductive substrate as in FIGS. 5 and 6, the xerographic plate should be charged positively.

The charge transport layer used within the purview of the present invention must be substantially non absorbing in the spectral region of intended use, but must be "electrically active" in that it allows injection of photoexited holes from the photoconductive layer, i.e. the charge generation layer, and allows these holes to be transported through the charge transport layer. As used herein, "electrically active" means that the material is capable of supporting the injection of photogenerated holes from the generating material and capable of allowing the transport of these holes through the active layer in order to discharge a surface charge on the active layer.

As indicated, the superior performance characteristics of the instant photosensitive element is due to the presence of from about 0.5 to 20 percent by weight of a toner release agent selected from the group of materials comprising stearates, silicon oxides, and fluorocarbons. Optimum performance results are obtained with photoreceptors containing from about 2 to 5% of the toner release materials disclosed herein.

Any suitable metallic stearate can be used to impart the improved characteristics already mentioned without detracting from the electrical properties of the xerographic plate. Especially preferred are zinc stearate, calcium stearate, magnesium stearate, cadmium stearate, barium stearate, lithium stearate, lead stearate, iron stearate, sodium stearate, aluminum stearate, nickel stearate, cobalt stearate and copper stearate.

Additionally, any suitable fluorocarbon may be used as a toner release material in the present invention. Preferred fluorocarbons include polyvinylidene fluoride such as that sold under the trademark Kynar and manufactured by the Penwalt Corporation.

The silicon oxide materials to be used as toner release agents within the purview of the present invention include silica and silicate materials. Preferred silicon oxide materials include amorphous silica such as that sold under the trademark "Aerosils" and manufactured by the Degussa Corporation.

The electrophotgraphic plates of the present invention may have additional thin bonding and/or charge control layers at any of the substrate interfaces shown in FIGS. 1–6. In many instances, a thin barrier layer is situated between the substrate and the photoconductive or electrically active layers in order to prevent undesirable charge injection. For example, thin layers of hole blocking metal oxide can be formed of various suitable known materials including aluminum oxide and the like. The primary purpose of this layer is to prevent hole injection from the substrate during and after charging. Typically, this layer is of a thickness of less than 50 angstroms. The thin adhesive layers are typically comprised of a polymeric material, including polyesters, polyvinyl butyral, polyvinyl pyrrolidone and the like. Typically, this layer is of a thickness of less than 0.3 microns.

Also included within the scope of the present invention are methods of imaging with the photoresponsive devices illustrated herein. These methods of imaging generally involve the formation of an electrostatic latent image on the imaging member, followed by developing the image with the developer composition, subsequently transferring the image to a suitable substrate and permanently affixing the image thereto. In those environments wherein the device is to be used in a printing mode, the imaging method involves the same steps with the exception that the exposure step is accomplished with a laser, device, or image bar, rather than a broad spectrum white light source. In the latter embodiment a photoresponsive device is selected that is sensitive to infrared illumination.

The following example further specifically defines the present invention with respect to a method of preparing the instant photosensitive member. The percentages are by weight unless otherwise indicated. The example is intended only to illustrate a preferred embodiment of the instant invention, and should not be interpretated as limiting the scope of the present invention.

EXAMPLE I

A one micron layer of vitreous selenium is formed over an aluminized Mylar (du Pont Trademark for polyethylene terephthalate) substrate by conventional vacuum deposition techniques such as those described in U.S. Pat. No. 2,753,278 and 2,970,906 to Bixby.

A charge transport layer is formed by admixing a polycarbonate resin binder (M-60 available from Mobay Chemical Company) in the amount of 20 grams in 180 grams of tetrahydrofuran and toluene solvent, the solvents being present in a ratio of approximately 9:1 by weight. 20 Grams of diethylhydrazone, 1 gram of zinc stearate and 0.05 grams of silicon oil (DC-200) is then added to the binder-solvent mixture. Additional tetrahydrofuran may then be added to adjust the viscosity to that appropriate for the chosen coating technique. In the instant example, the resulting solution was blade coated onto the selenium charge generation layer and the entire film dried at 100° C. in a forced air oven to form a multilayered xerographic element conforming to FIG. 1.

The prepared dual layered photoreceptor is tested by first charging the surface thereof to 850 volts in the dark, exposing the charged surface to illumination typical of that utilized in commercial xerographic apparatus under various light intensity conditions, and determining the light intensity necessary to discharge the element to a voltage of 50 volts. It was determined that the element of the present example required 1.7 microjoules per square centimeter for such discharge. Such value is indicative of excellent hole transport of the instant photoreceptor and that the present toner release agents do not disturb the electrical properties of the transport layer.

Xerographic elements essentially identical to this example and others conforming to FIGS. 2 to 6 were tested in commercially designed copy equipment and provided excellent results as to charge transport, resistance to toner filming, ease of cleaning, physical resistance to wear, long term stability of electrical and physical properties, reduced moisture sensitivity, and low temperature operation.

In view of the wide usage to which the present invention can be put, only limited embodiments of the invention have been described for purposes of illustration. It is, however, anticipated that various changes and modifications will be apparent to those skilled in the art, and that such changes and modifications may be made without departing from the scope of the invention as defined by the following claims.

What is claimed is:

1. An eleotrophotographic photoreceptor comprising:
   (a) a conductive supporting substrate; and
   (b) a photosensitive member comprising an electrically active transport material and a photogenerating material, the imaging surface layer of said member having dispersed therein from about 0.5 to 20 weight percent of a stearate toner release agent.

2. The electrophotographic photoreceptor of claim 1 wherein the photosensitive member is a monolayer comprising charge transport material having the photogenerating material and the toner release agent dispersed therein.

3. The electrophotographic photoreceptor of claim 2 wherein the toner release agent is dispersed in a gradient concentration throughout the monolayer, the larger concentration occurring at the imaging surface.

4. The electrophotographic photoreceptor of claim 1 wherein the toner release material is a metallic stearate.

5. The electrophotographic photoreceptor of claim 1 wherein the photosensitive member comprises a sandwich layer of charge generation material and an imaging surface overlayer of charge transport material having the toner release agent dispersed therein.

6. The electrophotographic photoreceptor of claim 1 wherein the photosensitive member comprises an interface layer of charge transport material and an imaging surface over layer of charge generation material having the toner release agent dispersed therein.

7. The electrophotographic photoreceptor of claim 1 further comprising a thin imaging overlayer surface of a polymeric resin having the toner release agent dispersed therein.

8. The electrophotographic photoreceptor of claim 1 wherein the charge transport materials are selected from the group of electrical active materials comprising triphenylmethanes, hydrazones, oxadiazoles, diamines, pyrazolines, styrils, antracenes, triazoles, and stilbenes.

9. The electrophotographic photoreceptor of claim 1 wherein the photogenerating material is selected from the group of inorganic photoconductors comprising - selenium, selenium alloys and cadmium sulfide.

10. The electrophotographic photoreceptor of claim 1 wherein the photogenerating material is selected from the group of organic pigment photoconductors comprising phthalocyanines, azos, squaryliums, perylenes, quinones, quinacridones, cyanimes and anthanthrones.

11. The electrophotographic photographic photoreceptor of claim 1 wherein the photogenerating material is poly (N-vinylcarbazole).

* * * * *